US005531506A

United States Patent [19]

Scott

[11] Patent Number: 5,531,506

[45] Date of Patent: Jul. 2, 1996

[54] RETRACTABLE SOFA TABLE WITH EXTENDED TABLE SURFACE

[75] Inventor: Donald G. Scott, Tupelo, Miss.

[73] Assignee: Action Industries, Verona, Mich.

[21] Appl. No.: 506,266

[22] Filed: Jul. 24, 1995

Related U.S. Application Data

[62] Division of Ser. No. 127,425, Sep. 27, 1993.

[51] Int. Cl.[6] ..... A47C 15/00

[52] U.S. Cl. ..... 297/463.1; 297/125; 297/146

[58] Field of Search ..... 297/124–126, 297/129, 118–120, 135, 173, 188.04, 188.14, 188.15, 380, 382, 144, 146, 463.1, 463.2, 188.01, 378.1; 248/277

[56] References Cited

U.S. PATENT DOCUMENTS

| | | | |
|---|---|---|---|
| 2,240,748 | 5/1941 | Bak | 155/123 |
| 2,714,419 | 8/1955 | Killington | 155/112 |
| 2,716,775 | 9/1955 | Kenimer | 297/125 X |
| 2,749,969 | 6/1956 | Tatter | 248/277.1 X |
| 2,926,948 | 3/1960 | Koplin et al. | 297/66 |
| 2,926,950 | 3/1960 | Hooverson | 297/66 |
| 2,926,951 | 3/1960 | Koplin | 297/66 |
| 2,942,649 | 6/1960 | Wells | 155/43 |
| 3,666,319 | 5/1972 | Moloney, Jr. | 297/113 |
| 3,951,448 | 4/1976 | Hawie | 297/113 |
| 4,536,027 | 8/1985 | Brennan | 297/124 |
| 4,541,133 | 9/1985 | Reiss et al. | 5/13 |
| 4,558,901 | 12/1985 | Yokoyama | 297/113 |
| 4,571,756 | 2/1986 | Castro et al. | 5/53 |
| 4,579,384 | 4/1986 | Sharod | 297/113 |
| 4,601,515 | 7/1986 | Hatsutta et al. | 297/361 |
| 4,779,923 | 10/1988 | Lang et al. | 297/194 |
| 5,104,182 | 4/1992 | Rasnick et al. | 297/194 |
| 5,286,084 | 2/1994 | Bart | 297/238 |
| 5,303,976 | 4/1994 | Nobile et al. | 297/146 |
| 5,322,344 | 6/1994 | Hoffman et al. | 297/191 |
| 5,375,907 | 12/1994 | Rogers et al. | 297/113 |

FOREIGN PATENT DOCUMENTS

| | | | |
|---|---|---|---|
| 284491 | 2/1928 | United Kingdom | 297/113 |
| 327905 | 4/1930 | United Kingdom . | |
| 438897 | 5/1935 | United Kingdom | 297/113 |

*Primary Examiner*—Milton Nelson, Jr
*Attorney, Agent, or Firm*—Bell, Seltzer, Park & Gibson

[57] ABSTRACT

A seating unit includes a seat frame, a foldable table assembly that includes a foldable panel pivotally attached to its rear edge, a four bar linkage which moves the table assembly between an open position and a closed position, and a roller which controls the rotational movement of the foldable panel about the rear edge of the table assembly. The seat frame includes a seat having a generally horizontal seat surface and a backrest having a recessed area and mounting panels positioned laterally of the recessed area. The foldable table assembly includes a decorative surface and a support surface generally opposed to the decorative surface. The foldable panel has an upper surface and a lower surface generally opposed to the upper surface. The four bar linkage is attached to the table assembly and to the mounting panels of the seat frame and moves the table assembly between a generally upright closed position, in which the table section is nested within the recessed area, and a generally horizontal open position, in which the decorative surface faces and is adjacent the seat surface and the support surface faces upwardly. When the table assembly is in the closed position, the upper surface of the panel is generally upright and confronts the support surface of the table assembly, and when the table assembly is in the open position, the panel is disposed generally horizontally rearward of the table assembly and the rear edge of the panel is free to move upwardly and forwardly.

4 Claims, 3 Drawing Sheets

RETRACTABLE SOFA TABLE WITH EXTENDED TABLE SURFACE

This application is a division of application Ser. No. 08/127,425, filed 27 Sep. 1993.

FIELD OF THE INVENTION

This invention relates generally to seating units that include a retractable sofa table, and more specifically relates to such seating units having an extendable table surface.

BACKGROUND OF THE INVENTION

A feature of sofas and couches that has become popular in the recent past with consumers is the retractable sofa table. Typically, a retractable sofa table includes a table surface and an opposing cushioned surface. The table is stored in a retracted position within a recess in the backrest of the sofa; while stored, the table is in a generally upright position, with the table surface facing the recess of the backrest and the upholstered surface blending with the remainder of the upholstery of the backrest. From this retracted position, the table can be moved to an extended, or open, position, in which the upholstered surface rests upon or adjacently overlies the seating surface of the sofa and the table surface faces upwardly, thereby providing a usable table surface for occupants of the sofa.

The major drawbacks to sofa tables that negatively impact their popularity are appearance and limited table size. In the open position, the rearmost end of the table (the end of the table surface nearest the backrest) is generally slightly forward of the profile of the backrest upholstery of the sofa. As a result, there is a gap between the rearmost edge of the sofa and the rear surface within the recess of the backrest. This gap is somewhat unsightly, particularly if the mechanism employed to control the movement of the table is exposed. Attempts to correct this deficiency include the attachment of a piece of fabric to the rear surface of the recess and the rear edge of the table; however, this solution is not entirely satisfactory, as the cloth, which dangles somewhat loosely from its attachment points in the open position, can become snagged on the mechanism as it opens.

Further, because the table typically extends rearwardly only to a point slightly forward of the upholstery profile, the table surface itself is limited in length to a dimension approximately equal to the height of the backrest of the sofa measured from the seat surface. This limitation can result in a rather small table surface, particularly if the sofa is of a style that utilizes a low backrest. Modification of the sofa table mechanism can be of some help, see co-assigned and co-pending U.S. patent application Ser. No. 07/922,563, but consumers are interested in tables of greater length.

One solution to increase the length of the table is offered in U.S. Pat. No. 2,240,748 to Bak, which discloses a sofa table having a panel hinged to its rear edge and to a cross member of the sofa frame located in the backrest. Sofa tables of this design can be used solely with sofas having a cross-member at the same height as the table in the open position. In addition, the dual hinging makes cleaning beneath the panel difficult, if not impossible.

In view of the foregoing, it is an object of the present invention to provide a seating unit-sofa table configuration that improves the appearance of prior art sofa tables.

It is also an object of the present invention to provide a sofa table with increased length which does not have the shortcomings of prior extended length sofa tables.

It is an additional object of the present invention to provide a mechanism suitable for use with a sofa table as described above.

SUMMARY OF THE INVENTION

These and other objects are satisfied by the present invention, which as a first aspect includes a seating unit comprising a seat frame, a foldable table assembly that includes a foldable panel pivotally attached to its rear edge, means for moving the table assembly between an open position and a closed position, and means for controlling the rotational movement of the foldable panel about the rear edge of the table assembly. The seat frame comprises a seat having a generally horizontal seat surface and a backrest having a generally upright and forwardly facing backrest surface. The backrest surface has a recessed area, and mounting panels are positioned laterally of the recessed area. The foldable table assembly comprises a decorative surface, a support surface generally opposed to the decorative surface and having a rear edge portion; and the aforementioned panel, has an upper surface and a lower surface generally opposed to the upper surface. The moving means, which is preferably a four-bar linkage, is attached to the table assembly and to the mounting panels of the seat frame and moves the table assembly between a generally upright closed position, in which the table section is nested within the recessed area with the decorative surface facing forward, and a generally horizontal open position, in which the decorative surface faces and is adjacent the seat surface and the support surface faces upwardly. The means for controlling the rotational movement of the panel are configured so that when said table assembly is in the closed position, the panel is generally upright and the upper surface of the panel confronts the support surface of the table assembly, and when the table assembly is in the open position, the panel is disposed generally horizontally rearward of the table assembly and the upper surface faces generally upwardly. The panel controlling means is configured so that when the panel is in the open position, the rear edge of the panel is free to move upwardly and forwardly. Preferably, the means for controlling the rotational movement of the panel comprises a rotatable roller that is integral with the moving means and an elastic spring attached between the lower surface of the panel and the sofa frame.

A second aspect of the present invention is a mechanism suitable for moving a table assembly of the type described above between the open and closed positions and also for controlling the rotational movement of the panel of the table assembly. The mechanism comprises a mounting bracket adapted for mounting to a sofa frame, means for supporting the panel attached to the upper end of the mounting bracket, a lower pivot link pivotally interconnected with the lower end of the mounting bracket at a first pivot, an upper pivot link pivotally interconnected with the mounting bracket at a second pivot intermediate of the first pivot and the roller, and a table mounting bracket adapted to be fixed to a retractable sofa table, pivotally interconnected to the lower pivot link at a third pivot, and further pivotally interconnected with the upper pivot link at a fourth pivot. The mechanism is configured so that in a first rotative orientation, the mounting bracket is generally upright, the upper end of the mounting bracket is facing upwardly, the fourth pivot is positioned upwardly and rearwardly of the third pivot, and the table mounting bracket has a first angular orientation, and in a second rotative orientation, the mounting bracket remains generally upright and the fourth pivot is positioned upwardly and forwardly of the third pivot, and the table mounting bracket has a second angular orientation. The angular difference between the first angular orientation and the second angular orientation is preferably between about 90 and 140 degrees, and more preferably is between about 100 and 120 degrees.

DETAILED DESCRIPTION OF THE INVENTION

The present invention will now be described more particularly hereinafter with reference to the accompanying drawings, in which a present embodiment of the invention are shown. The invention, can, however, be embodied in many different forms and should not be limited to the embodiments set forth herein; rather, these embodiments are provided so that this disclosure will be thorough and complete, and will fully convey the scope of the invention to those skilled in the art.

The present invention is directed at a seating unit having a foldable table attached to nest in a retracted position within the backrest of the seating unit and move into an extended position above the seat of the seating unit in which it can provide a suitable table surface for the placement of food, drinks, games, playing cards, reading materials, and the like. As used herein, the terms "front," "forward," and "forwardly" refer to the direction defined by a vector extending substantially parallel to the surface underlying the seating unit extending from the backrest toward the seat. Conversely, the terms "rear," "rearward" and "rearwardly" refer to the direction directly opposite the forward direction; i.e., defined by a vector substantially parallel to the underlying surface extending from the seating surface toward the backrest. The terms "lateral" and "laterally" refer to the direction defined by a vector originating in the center of the seating surface and extending substantially parallel to the underlying surface toward the external edges of the seating unit perpendicular to the forward and rearward directions. The terms "inboard," "inward," and "inwardly" refer to the direction directly opposite to the direction defined above as "lateral;" i.e., the direction defined by a vector extending substantially parallel to the underlying surface and originating at the external edges of the seating unit and extending toward its center perpendicular to the forward and rearward directions.

Figure 1:
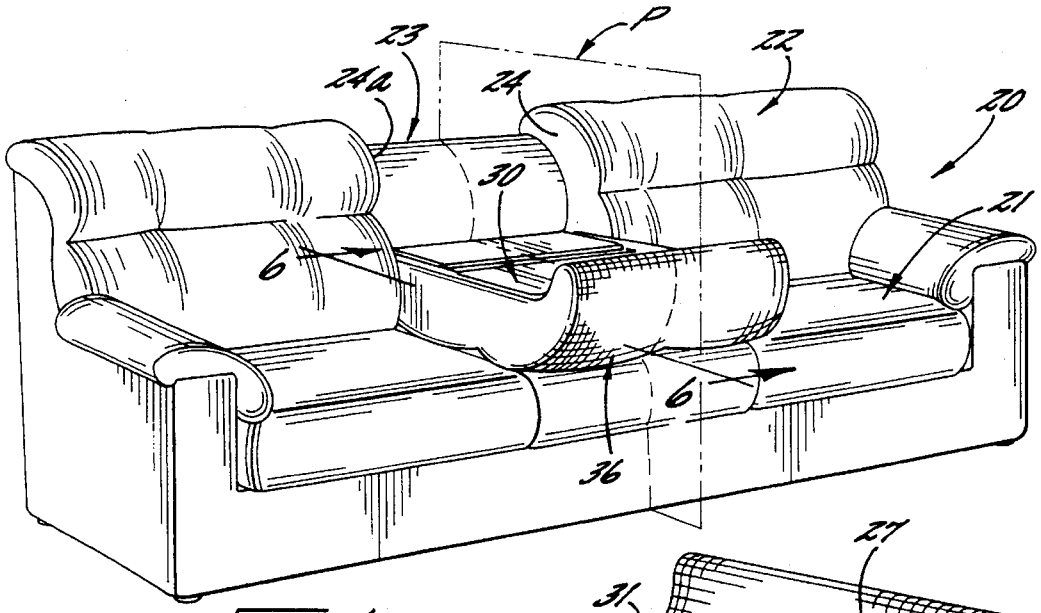
FIG. 1 shows a perspective view of a sofa having a sofa table, the sofa table being in the open position.
Figure 2:
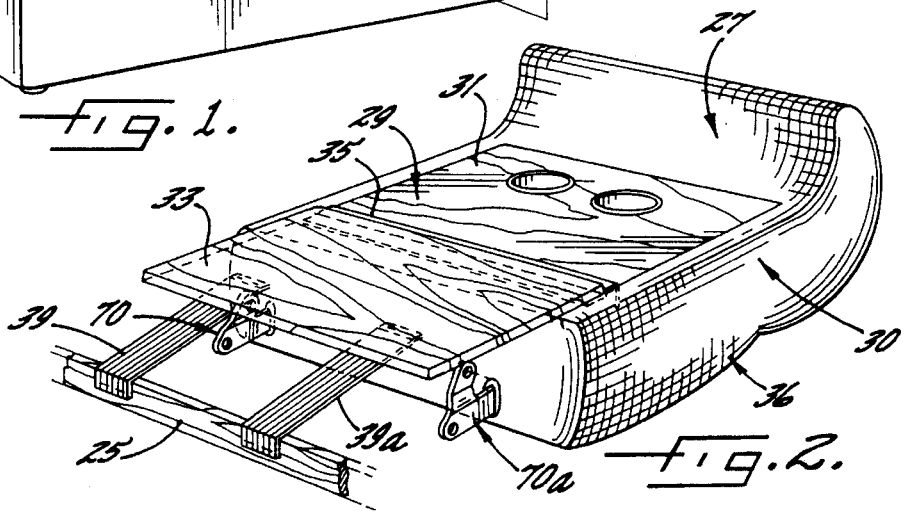
FIG. 2 shows a perspective view of a sofa table showing a table surface and a table panel.
Figure 3:
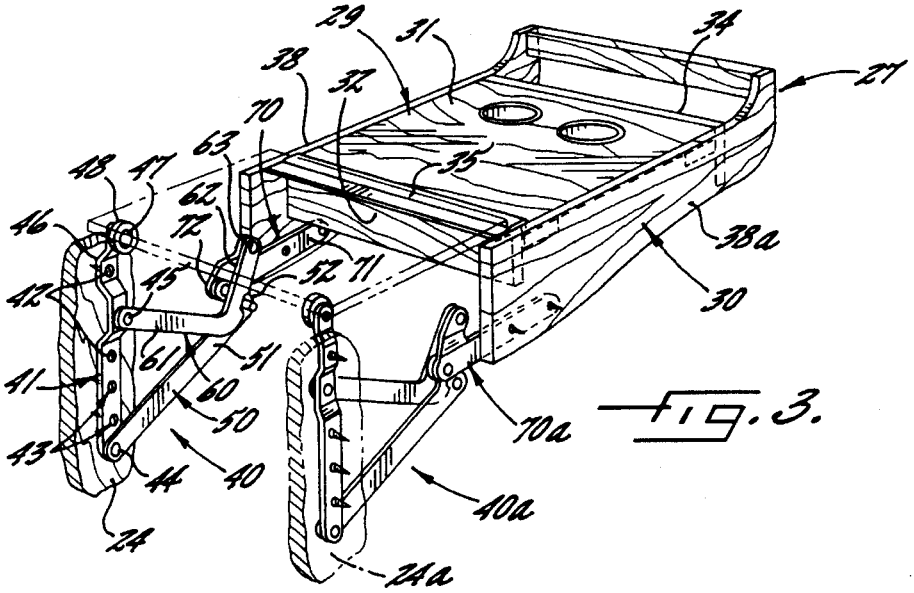
FIG. 3 shows a cutaway view of the sofa table frame and a mechanism connecting the sofa table to side panels of a sofa.

A current embodiment of the invention is shown in FIGS. 1–5. A sofa, broadly designated at 20, is shown in FIG. 1. The sofa 20 includes a seat surface 21, a backrest surface 22 and a recessed area 23. A pair of side panels 24, **24*a* vertically line the lateral edges of the recessed area 23; a cross member 25 is mounted horizontally between the side panels 24, 24*a*. Although a sofa 20** is illustrated herein, it will be appreciated by those skilled in this art that any type of seating unit, including a chair, love seat, pit-style modular sofa, and the like, which includes a backrest and a seat is suitable for use with the sofa table and mechanism described herein. In addition, the invention can be used with a seating unit that houses within its frame a foldable bed; an exemplary mechanism configuration for moving a sofa table attached to this type of sofa is disclosed in co-pending and co-assigned U.S. patent application Ser. No. 08/034,495, the disclosure of which is incorporated herein by reference in its entirety.

The sofa 20 includes a sofa table 30 (FIG. 2) that rests within the recessed area 23 of the backrest 22 in the retracted position. The sofa table 30 includes a rectangular frame 37 (FIG. 3) comprising a pair of lateral side panels 38, **38*a* which are fixed to a front rail 34 and a rear rail 32. An arcuate portion 27 is located at the forwardmost edge of the sofa table 30; this portion conforms to and mates with the top portion of the recessed area 23 of the sofa 20 when the sofa table 30 is in the retracted position. The forwardly facing surface of the sofa table 30 (as seen in the retracted position shown in FIG. 4) comprises an upholstered surface 36, although any decorative surface that blends with the design of the remainder of the backrest 22 when the sofa table 30 is in the retracted position is suitable. A support surface 29 opposed to the decorative surface (i.e., the surface that faces upwardly when the sofa table is in the extended position FIG. 6) comprises a planar table surface 31 and a planar table panel 33. The table panel 33 is pivotally attached at its forward end to the rearward end of the upper table surface 31 with a cloth hinge 35. Although a cloth hinge is illustrated herein, it will be appreciated by those skilled in this art that any means for providing pivotal movement of the table panel 33 about the upper support surface 31, such as a conventional pin and socket hinge, is suitable for use in this application. The underside of the rear end portion of the panel 33 is attached to a pair of elastic straps 39 39*a*, each of which extends over the upper surface of the cross member 25** and is fixed to the rearward surface thereof.

A pair of sofa mechanisms 40, **40*a* interconnect the sofa 20 and the sofa table 30. The mechanisms control the movement of the sofa table 30 between the retracted position (FIG. 4), in which the sofa table 30 is disposed generally upright and nested within the recessed area 23, and the extended position (FIG. 6), in which the upholstered surface 36 faces and is adjacent the seat surface 21 and the table surface 31 faces upwardly. These mechanisms are mirror images of one another about a vertical plane of symmetry P that extends through the center of the sofa table 30 parallel to the side panels 38, 38*a*. For clarity and brevity, only the mechanism 40 will be described in detail herein; those skilled in this art will appreciate that the mechanism 40*a* is configured and operates as the mirror image of mechanism 40**.

The mechanism 40 comprises a mounting link 41, a lower pivot link 50, an L-shaped upper pivot link 60 and a table mounting bracket 70. These links as pivotally interconnected to form a four-bar linkage. As used herein, "four-bar linkage" means a hinged chain of links having one rotational degree of freedom and equivalent structures, such as a slider-crank mechanism, see, e.g., Paul, *Kinematics and Dynamics of Planar Machinery* (Prentice-Hall, Inc. 1979). This term is intended to encompass mechanical configurations having multiple interconnected four-bar linkages.

Those skilled in the art will appreciate that there are a number of suitable means for moving the sofa between the retracted and extended positions, including other mechanical configurations and combinations of mechanical and pneumatic units.

The mounting link 41 is fixed to the inboard surface of the side panel 24 by threaded fasteners 42, which are inserted through apertures 43 into the side panel 24. The mounting link 41 is pivotally interconnected to the lower pivot link 50 at a pivot 44 positioned at the lower end of the mounting link 41. The mounting link is also pivotally interconnected to the upper pivot link 60 at a pivot 45 that is positioned above the lower pivot 44. These and the other pivots disclosed herein can be of many configurations known to those skilled in the art for providing pivotal movement between adjacent links, such as rivets, pins and bushings, and the like.

An upper arm 46 of the mounting link 41 extends upwardly above the pivot 45. The upper arm supports a pin 47 upon which roller 48 is mounted and rotates. The upper arm 46, pin 47 and roller 48 are sized and positioned so that the lower surface of the table panel 33 rests upon the apex of the roller 48 when the sofa table 30 is in the extended position and the upper surface of the panel 33 is essentially coplanar with the upper table surface 31. The roller 48 should also be positioned above and forwardly of the cross member 25 so that the elastic straps 39, **39*a* remain in tension as the sofa table 30 moves between the retracted and extended positions, thereby biasing the table panel 33 downwardly and rearwardly to maintain contact with the roller 48. It should be understood that any means for biasing the table panel 33 to retain contact with the roller 48 during the movement of the sofa table 30, such as helical springs or weights in the rearmost position of the table, is suitable for us with the invention. The attachment of the roller 48 to the mounting link 41 is preferred, as this combination facilitates proper positioning of the roller 48 relative to the remainder of the mechanism 40 and the straps 39, 39*a*; however, those skilled in this art will appreciate that the roller 48, or any support means for contacting the underside of the table panel 33 and permitting sliding movement thereon and rotation thereabout, such as an arcuate camming surface, can be formed and mounted to the sofa frame 21 separately from the mounting link 41**.

The lower pivot link 50 comprises a long lower arm 51 and a shorter upper arm 52. At one end the lower arm 51 is pivotally interconnected to the mounting link 41 at pivot 44. At its other end the lower arm 51 is fixed to the upper arm 52 so that the angle therebetween is approximately 135°. The upper arm 52 is pivotally interconnected at the end opposite its fixed attachment to the lower arm 51 to the table mounting bracket 70 at a pivot 53. In addition, a stop pin 54 extends inwardly from its fixed mounting at the vertex between the lower arm 51 and the upper arm 52. Although the illustrated configuration for the lower pivot link 50 is preferred, those skilled in this art will appreciate that this link can take many configurations, including straight, angled, curvilinear, and the like, and be suitable for use in this invention.

The upper pivot link 60 comprises a lower leg 61 and an upper leg 62. The lower leg 61 is pivotally interconnected with the mounting link 41 at the pivot 45 and is fixed at its opposite end to the upper leg 62 so that the angle formed therebetween is approximately 90 degrees. The upper leg 62 is pivotally interconnected at the end opposite its fixed attachment with the lower leg 61 to the mounting bracket 70 at a pivot 63.

In this preferred configuration, the upper pivot link 60 can reside beneath and rearward of the sofa table 30, thereby "nesting" the sofa table 30, when the sofa table 30 is in the retracted position. As such, the mechanism 40 can be positioned on the inboard surface of the side panel 38 of the sofa table 30 so that in the extended position, the mechanism 40 is not laterally exposed to mar the appearance of the sofa 20. This and other advantages of this configuration are disclosed in co-pending U.S. patent application Ser. No. 07/922,563, the disclosure of which is incorporated herein by reference in its entirety. Those skilled in this art will appreciate that although the substantially L-shaped configuration is preferred, the upper pivot link 60 can take a variety of configurations, such as straight, angled, curved, serpentine, and the like, and still be suitable for use with the present invention.

The table mounting bracket 70 comprises a long arm 71 and a short arm 72. One end each of the arms 71, 72 are fixed to one another at vertex 73 to form an angle of approximately 45 degrees. The pivot 53 that pivotally interconnects the table mounting bracket 70 to the lower pivot link 50 is located at the vertex 73. The table mounting bracket 70 is pivotally interconnected to the upper pivot link 60 at the pivot 63, which is located at the end of the short arm 72 opposite the vertex 73. The mounting bracket is fixed to the inboard surface of the side panel 38 of the sofa table 30 by threaded fasteners 74, which are inserted through apertures 75 and into the side panel 38.

Figure 4:
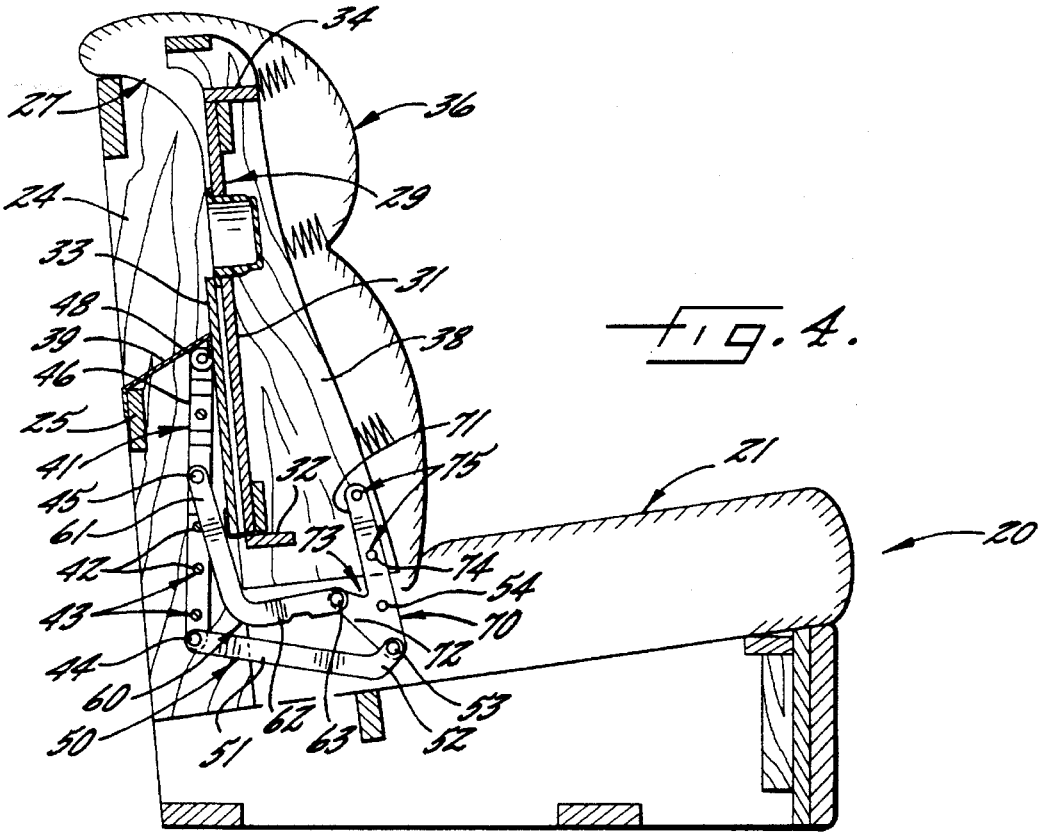
FIG. 4 is a cross-sectional view of a sofa table and mechanism showing each in the closed position.
Figure 6:
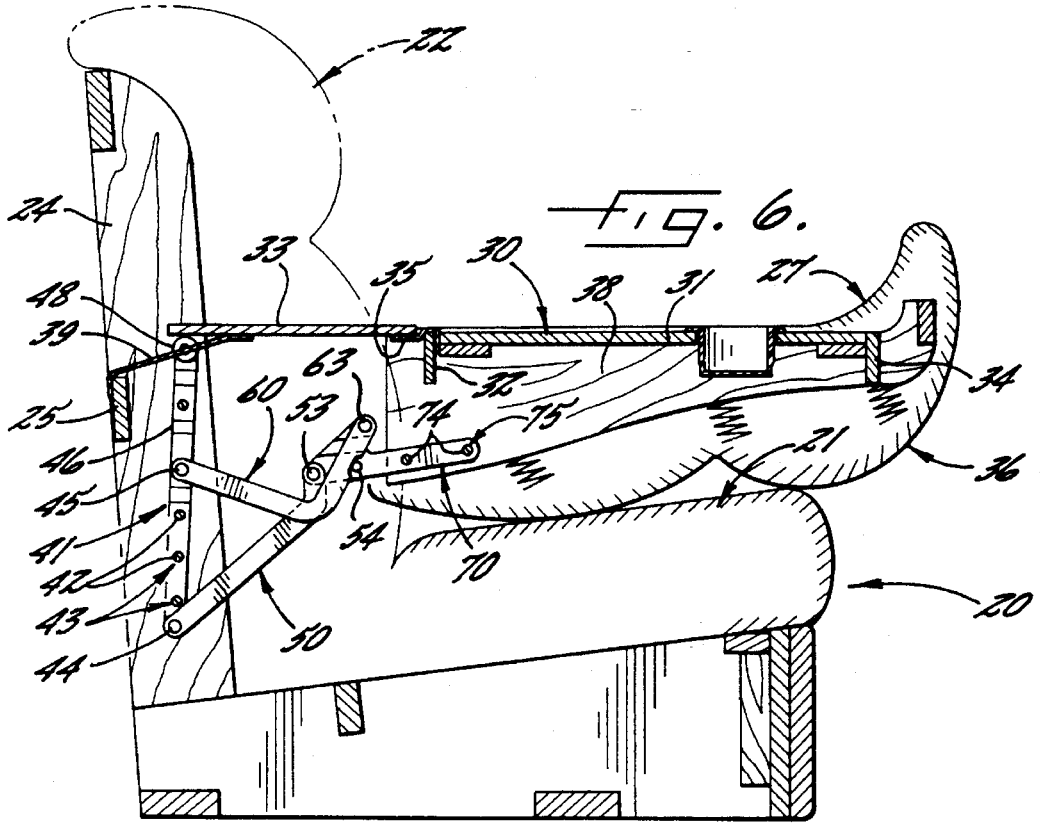
FIG. 6 is sectional view taken along line 6—6 of FIG. 1 in the open position.
Figure 5:
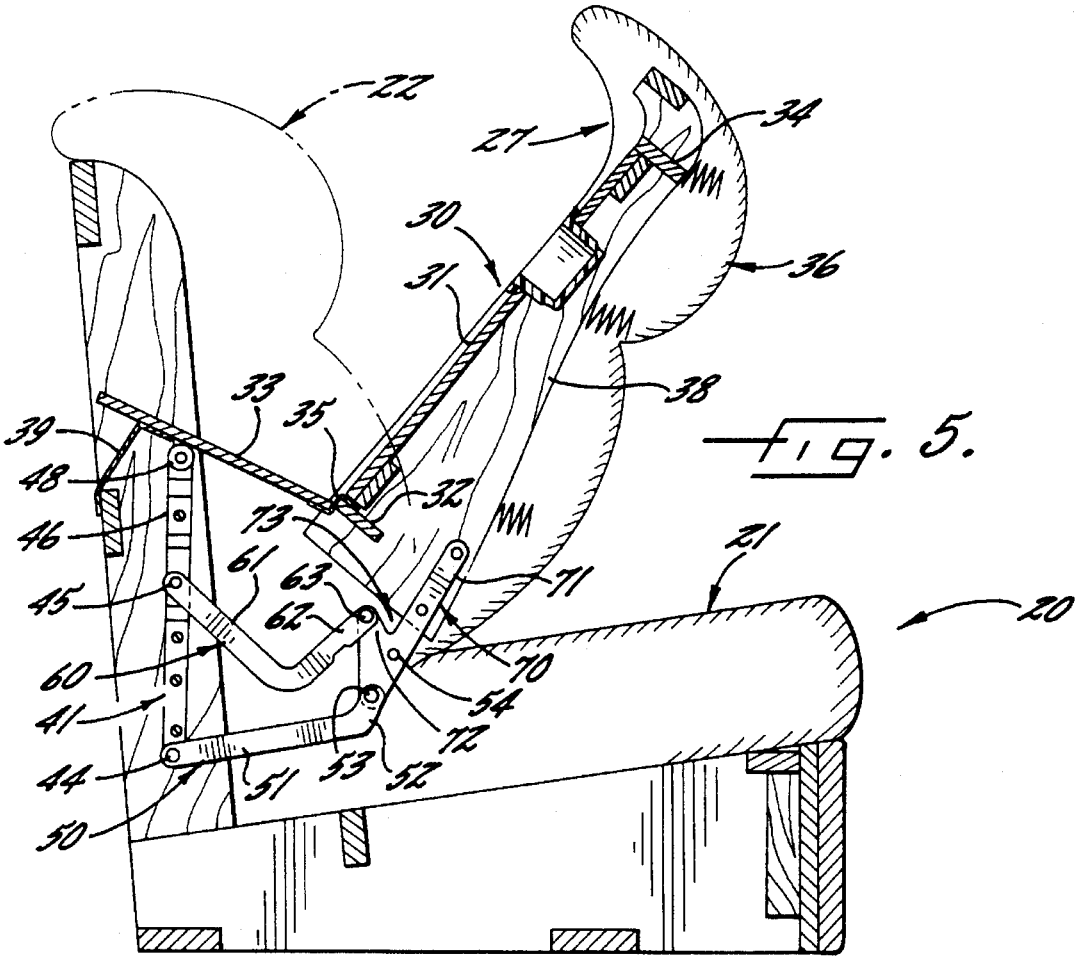
FIG. 5 is a cross-sectional view of a sofa table and mechanism showing each in an intermediate position.

The operation of the sofa table 30 and mechanism 40 is best understood by comparing its orientation in the retracted position shown in FIG. 4 to its orientation in the intermediate position shown in FIG. 5 and the extended position shown in FIG. 6. In FIG. 4, the sofa table 30 is shown in its retracted position, in which it is generally vertically disposed and nested within the recessed area 23 of the backrest surface 22. The upholstered surface 36 is essentially coplanar with the upholstery covering the remainder of the backrest surface 22. The table panel 33 is generally upright and is pivoted about the cloth hinge 35 to confront the upper table surface 31. The elastic straps 39, **39*a* bias the table panel 33 rearwardly so that the lower surface of the table panel 33 contacts a forward portion of the roller 48. The pivots 45, 63, and 53 are virtually aligned in an "on-center" condition; although not present in this embodiment, one skilled in the art will understand that a true "on-center" condition for these pivots would create a locking mechanism which would help to retain the sofa table 30** in the retracted position.

The sofa table 30 is moved toward the extended position through the application of a forwardly-directed force to the front rail 34 or the arcuate top portion 27 of the sofa table 30. This force causes the sofa table 30, and thus the table mounting bracket 70 fixed thereto, to rotate so that the arcuate front edge portion 27 moves forwardly. Pivoting of the mounting bracket 70 about the pivots 53 and 63 draws the lower and upper pivot links 50, 60 upwardly, which in turn drives the rearward portion of the sofa table assembly 30 upwardly and forwardly. This action causes the forward edge of the table panel 33 to slide rearwardly on the roller 48 and also causes the panel 33 to pivot about the cloth hinge 35 away from the upper support surface 31 (FIG. 5).

A force directed forwardly and downwardly effects continued movement of the sofa table 30 to the extended position shown in FIG. 6. The rotation of the table mounting bracket 70 draws the pivot 53 upwardly and rearwardly and the pivot 63 upwardly and forwardly. This juxtaposed action eventually causes the forward edge of the short arm 62 of the upper pivot link 60 to contact the stop pin 54, at which point the movement of the sofa table 30 ceases. The entire range of motion between the retracted and extended positions causes the angular orientation of the sofa table 30 relative to the underlying surface to change about 110 degrees, although those skilled in this art will understand that the present invention can be used on seating units that require an angular orientation change of between about 90 and 140 degrees, and more preferably between about 100 and 120 degrees.

As the sofa table 30 rotates thusly, the lower surface of the table panel 33 slides forwardly on the roller 48 as the upper surface of the panel 53 continues to rotate away from the upper support surface 31; movement of the table panel 33 ceases as the table panel 33 reaches a generally horizontal position in which the upper surface of the table panel 33 is essentially coplanar with the upper table surface 31. The tension in the straps 39, 39*a*, forces the panel 33 to remain in contact with the roller 48 throughout the movement of the sofa table 30 between the retracted and extended positions. The combination of the biasing of the straps 39, 39*a* and the support of the roller 48 control the rotation of the panel 33 about the upper table surface 31. Those skilled in this art will appreciate that any means for controlling the rotation of the panel 33 about the upper table surface 31 which is configured so that when the panel 33 is in the open position, the rear edge of the panel 33 is free to move upwardly and forwardly, is suitable for use with the present invention. Exemplary alternatives include the use of a weighted panel 33, a four-bar linkage that slides the panel 33 into the desired positions, and the like.

It should be noted that, as is clear in FIG. 1 and FIG. 6, when the sofa table 30 is in the open position, the table panel 33 extends from the upper table surface 31 to the recessed area 23. Thus, the entirety of the mechanism 40 is disposed below the table panel 33 of the sofa table 30. This disposition provides a much more visually appealing seating unit when viewed by an occupant of the sofa or an observer facing the front of the sofa 20, as all of the linkages of the mechanism 40 are hidden from view. Furthermore, the table panel 33 in the extended position greatly increases length of the upper support surfaces 29 with no increase in length and only a slight increase in thickness of the sofa table 30. Because the rear edge of the panel 33 is free to move upwardly and forwardly away from the recessed area, sofa tables of this configuration do not have the shortcomings of sofa table embodiments in which a panel is hinged directly to a cross-member in the backrest of the sofa; the panel 33 can be pivoted about hinge 35 for cleaning, and the table 30 can be used with sofas having a variety of backrest configurations.

The drawings and specifications disclose typical preferred embodiments of the invention, and, although specific terms are employed, they are used in a generic and descriptive sense only and not for the purpose of limitation, the scope of the invention being set forth in the following claims.

That which is claimed is:

1. A mechanism suitable for use with a retractable sofa table that includes a panel pivotally attached to its rear edge, said mechanism comprising:

(a) a mounting bracket adapted for mounting to a sofa frame, said mounting bracket having an upper end and a lower end;

(b) panel supporting means for supporting the panel attached to said upper end of said mounting bracket configured so that the panel is free to slide thereon;

(c) a lower pivot link pivotally interconnected with said lower end of said mounting bracket at a first pivot;

(d) an upper pivot link pivotally interconnected with said mounting bracket at a second pivot intermediate of said first pivot and said panel supporting means;

(e) a table mounting bracket adapted to be fixed to the retractable sofa table, pivotally interconnected to said lower pivot link at a third pivot, and further pivotally interconnected with said upper pivot link at a fourth pivot;

said mechanism being configured so that in a first rotative orientation, said mounting bracket is generally upright, said upper end of said mounting bracket is facing upwardly, said fourth pivot is positioned upwardly and rearwardly of said third pivot, and said table mounting bracket has a first angular orientation, and in a second rotative orientation, said mounting bracket remains generally upright and said fourth pivot is positioned upwardly and forwardly of said third pivot, and said table mounting bracket has a second angular orientation, the angular difference between the first angular orientation and the second angular orientation being between about 90 and 140 degrees.

2. A mechanism according to claim 1, wherein said upper pivot link includes a bend disposed toward said lower pivot link when said mechanism is in the first rotative orientation.

3. A mechanism according to claim 1, wherein the angular difference between said first angular orientation and said second angular orientation is between about 100 and 120 degrees.

4. A mechanism according to claim 1, wherein said panel supporting means comprises a roller.

* * * * *